United States Patent [19]

Hickey

[11] 4,174,107

[45] Nov. 13, 1979

[54] TETHERED BALL TENNIS PRACTICE DEVICE

[75] Inventor: Robert B. Hickey, Pembroke Pines, Fla.

[73] Assignee: George L. Mitchell, Miami, Fla.

[21] Appl. No.: 829,295

[22] Filed: Aug. 31, 1977

[51] Int. Cl.[2] ..... A63B 61/00

[52] U.S. Cl. ..... 273/29 A; 220/375; 273/58 C

[58] Field of Search ..... 273/26 E, 58 C, 58 BA, 273/29 A, 95 A, 95 AA, 200 R, 58 R, 61 R; 220/218, 219, 375

[56] References Cited

U.S. PATENT DOCUMENTS

| | | | |
|---|---|---|---|
| 1,450,077 | 3/1923 | Haas | 220/375 |
| 1,543,256 | 6/1925 | Grant | 220/375 |
| 2,621,046 | 12/1952 | Lamounette | 273/58 C |
| 2,747,873 | 5/1956 | Carroad | 273/58 C |
| 2,865,636 | 12/1958 | Blackmun | 273/95 A |
| 3,051,491 | 8/1962 | Cabot | 273/95 A |
| 3,380,738 | 4/1968 | Papp | 273/26 E |
| 3,918,712 | 11/1975 | Fay | 273/58 C |

FOREIGN PATENT DOCUMENTS

| | | | |
|---|---|---|---|
| 883872 | 7/1973 | Fed. Rep. of Germany | 273/95 A |
| 688151 | 2/1973 | United Kingdom | 273/95 A |

OTHER PUBLICATIONS

Mechanix Illustrated, Jan. 1971.

*Primary Examiner*—Richard C. Pinkham
*Assistant Examiner*—T. Brown
*Attorney, Agent, or Firm*—Bernard & Brown

[57] ABSTRACT

A tennis practice device which uses a hollow container which may be filled with sand or water as an anchor for a tennis ball attached to the lid of the container by means of an elongated elastic line. The line is attached to the tennis ball by means of a nylon adapter line which is threaded through the ball and tied in a loop. The elastic line is attached to the lid by means of a swivel hook. The device provides a completely portable tennis practice apparatus which may be filled with a weighty material during use and which serves as a storage container for the tennis ball and line when it is not in use.

8 Claims, 2 Drawing Figures

TETHERED BALL TENNIS PRACTICE DEVICE

BACKGROUND OF THE INVENTION

This invention relates to a portable tennis practice device which includes a tennis ball attached to a weighted container by an elastic line and, more particularly, to a device employing a hollow container which may be filled with a weighting material during use and which may serve as a storage container for the tennis ball and line when it is not in use.

Tennis practice devices are useful in teaching the rudiments of tennis to a beginner and for providing exercise and entertainment to tennis players at all levels of skill. Because a minimum degree of skill is necessary to play the game of tennis enjoyably, it is often difficult for a beginner to find someone to play with. Also because tennis is most enjoyably played between individuals who are at about the same level of skill, even experienced players sometimes have difficulty in finding a sufficiently challenging partner to polish and improve his skills. There is, therefore, a need for players at all levels to have a means for practicing their game.

The most traditional practice medium is a practice wall. However, many players do not have a sufficiently large wall and encompanying play area available to them. Resilient "playback nets" can be a suitable alternative but they are used to best advantage by an experienced player because target area is small and the rebound is often erratic. These devices can be bulky and are often expensive.

Devices do exist whereby a tennis ball is attached by means of an elastic string to a saucer-light weight. The player places the weight at his feet and hits the ball. The elastic line returns the ball so that it can be hit again. Although these devices can be satisfactory, many players find that the return trajectory of the ball can be erratic and the weight tends to slide so the practice value and enjoyment obtained from such devices is limited.

There is need for an inexpensive, completely portable tennis practice device which can be used in a limited space by players at all levels of skill. It is particularly important that the device provide a return trajectory for the tennis ball which is regular and not erratic. Return trajectory control is important so that a player can repeatedly practice forehand, backhand, overhand and serving strokes or mix the strokes in a desired pattern. This is not possible if the return trajectory is erratic.

SUMMARY OF THE INVENTION

The present invention provides a tennis practice device which meets all of the above-mentioned requirements. It is an inexpensive, lightweight and completely portable apparatus which may be used by tennis players at every level of skill to improve their strokes and to provide exercise and enjoyment.

I have found that the regularity of the return trajectory of the ball is improved by attaching the elastic line to the weighted container at a point well above the playing surface but low enough so as not to interfere with the swing of the racquet or to cause the container to tip over easily. It is also desirable to reduce the surface area occupied by the device to provide greater room for the user's footwork. I have included both of these features in my invention by using a hollow, generally cylindrical container as an anchor for the ball and elastic line which has a height greater than the diameter of its base. The container is made of an unbreakable material, preferably plastic and it need not be cylindrical but can be any convenient shape.

The hollow container has a wide opening at the top for receiving a weighting material, preferably sand, but alternatively water. This permits my device to be lightweight and completely portable and at the same time to provide a good anchor for the ball during use.

A cap is provided to contain the weighting material inside the container. An elastic line is attached to the lid of the container by means of a fastener which can be integral with the lid or which can be a separate piece attached through an opening in the center of the lid. In order to minimize coiling of the elastic line during use, the line may be attached to the fastener by means of a leader and a swivel. A pressureless tennis ball is attached to the other end of the elastic line by means of a nylon cord threaded through the tennis ball. The elastic line is tied directly to the cord and is not itself threaded through the tennis ball. This provides a strong and durable means for connecting the tennis ball to the elastic line.

To use the tennis practice device the user simply fills the container with sand or water, attaches the cover to the container, positions the container on a flat surface in an open area and strokes the ball.

The user should be able to stand close enough to the practice device so that he can swing the center of his tennis racquet face over the point where the elastic line attaches to the container lid. Because the user will be positioned close to the practice device, it is desirable that the device occupy as small a surface area as possible so that it will not interfere with the player's footwork.

The prior art saucer-like devices depend for their stability on having a base diameter much greater than the height. Raising the height of a saucer-like device to improve return trajectory requires too wide a base. This also can increase the weight of the device so that it will no longer be completely portable.

My present invention provides a relatively high attachment point for the elastic line and at the same time occupies a minimum surface area. This provides a regular return trajectory for the ball and greater room for the user's footwork.

DESCRIPTION OF THE DRAWINGS

The invention will be more fully understood from the following detailed description taken in conjunction with the accompanying drawings in which.

DETAILED DESCRIPTION OF THE INVENTION

Figure 1:
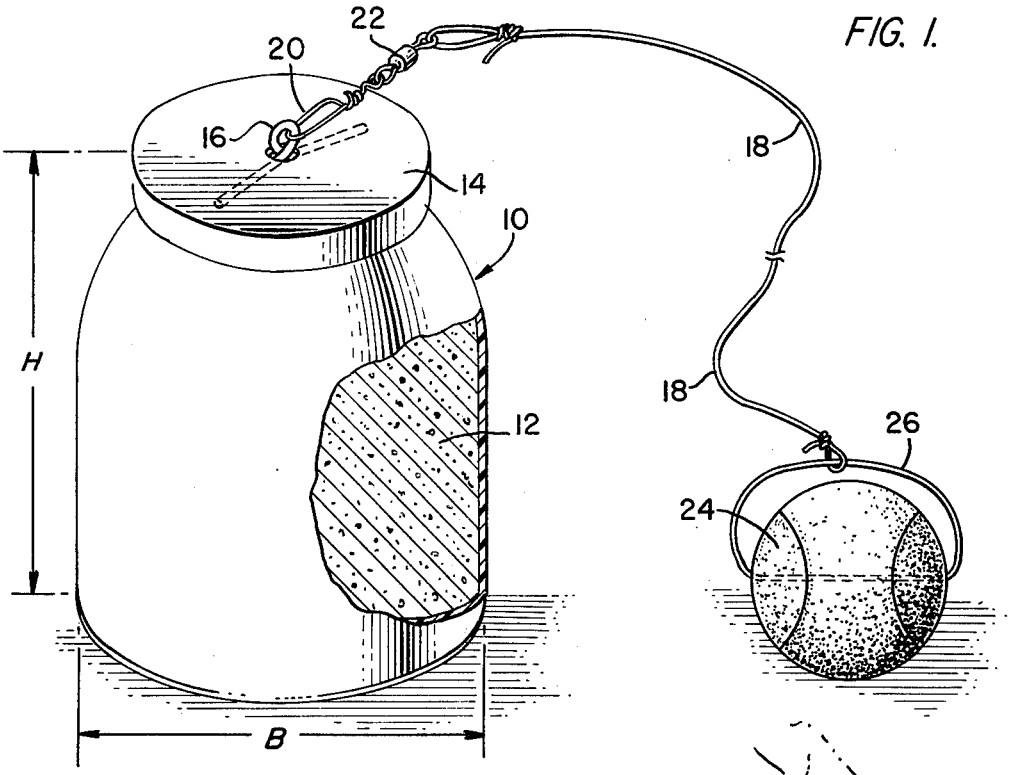
FIG. 1 is a perspective view of the tennis practice device of the present invention ready for use; and, FIG. 2 is a perspective view of the tennis practice device shown with the tennis ball and elastic line still inside the device.
Figure 2:
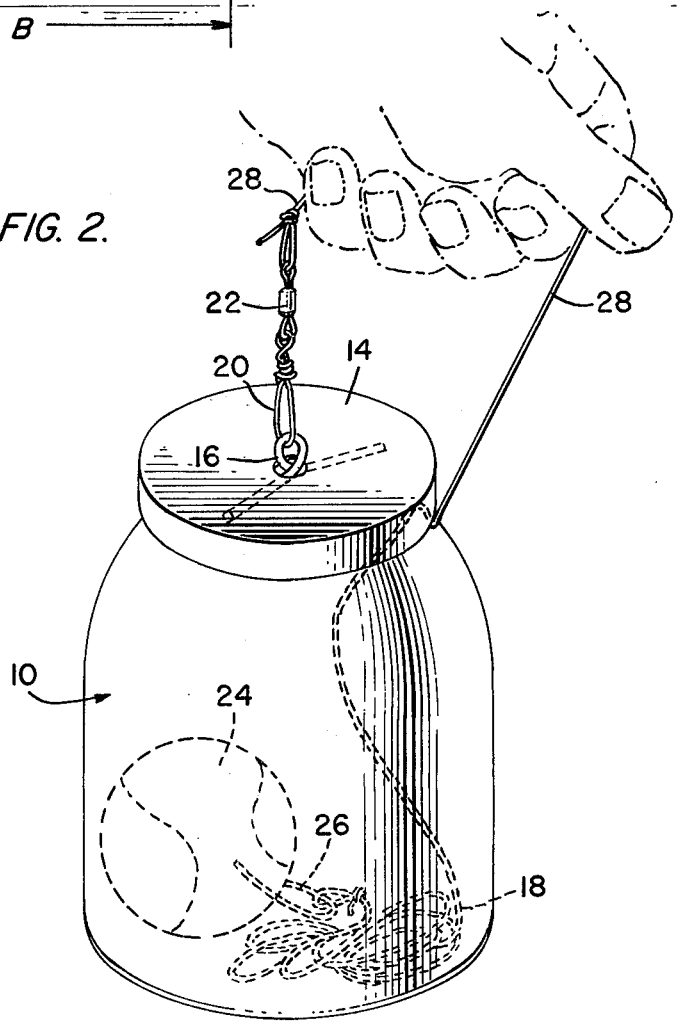

Referring to FIG. 1, there is shown a hollow, generally cylindrical container, 10, whose height, H, is greater than the diameter B of its base. I have found that a container having a height of approximately 7 inches and base diameter of approximately 5½ inches provides satisfactory results, but these particular dimensions are not critical to the proper operation of my invention. The height should be high enough so that the container does not slide but low enough so that the container does not readily tip over or interfere with the swinging of the tennis racquet during use. Container 10 is preferably made of an unbreakable material such as plastic. Container 10 has a wide opening at its top through which the container may be filled with a weighting material 12. I have found that sand is a preferable weighting material but many people find that water is a satisfactory alternative. The top of container 10 is closed by a lid 14 which threads onto the container by means of cooperating threads disposed on lid 14 and around the opening in container 10. Lid 14 is preferably made of a strong, rigid material such as heavy gauge plastic. A metal lid may be used but because water is often used as the weighting material, it is preferable to use a plastic lid which will not rust or corrode.

Projecting through a hole in the center of the lid is a cotter pin type fastener 16 whose loop extends through lid 14 towards the outside of container 10 and whose arms spread out on the inside of lid 14 to provide a means for securing one end of an elastic line 18 to the lid. Cotter fastening 16 is preferably made from plastic coated wire of sufficient gauge so that its arms will remain spread during use and will not pull out of the lid.

The elastic line 18 is removably connected to fastener 16 by means of a finishing-type leader 20. The leader 20 may be easily unclasped so that the elastic line 18 may be quickly removed from the fastener 16. Leader 20 is connected to one end of a swivel 22. The elastic line is directly connected to the other end of the swivel 22. This swivel 22 allows the line to move freely during use with a minimum of knotting and coiling.

The other end of elastic line 18 is attached to a pressureless tennis ball 24 by means of an adapter line 26. Adapter line 26 which is preferably made of nylon is passed through punctures in opposite sides of pressureless ball 24. The free ends of adapter line 26 are tied together to form a loop and the knot is slid over to one side adjacent the surface of the ball so as not to impede the action of elastic line 18. The end of elastic line 18 is tied securely to the center of loop or may be tied in a loop so that the line 18 will slide along adapter line 26. A pressureless ball is used because it has much more bounce than a regular tennis ball and because it will maintain its bounce indefinitely.

Elastic line 18 is preferably made of a rubber cord encased in a braided fabric, preferably of nylon. I also prefer an elastic line having a relaxed length of preferably about 15 feet although this length may be adjusted to suit a particular player preference. I have found that elastic lines of from 13 to 17 feet work satisfactorily. A short line provides a fast return. A longer line can provide a slower return but also requires the player to stroke the ball harder.

My practice device may be used by filling container 10 with a weighting material 12, preferably sand, securing lid 14 to the top of container 10 and attaching the ball 24 and the elastic line 18 to cotter pin type fastener 16 by means of the detachable leader 20. The device is placed on a flat hard surface in an open area so that the ball will bounce freely. The user stands about two feet behind and two feet to the side of the container so that when he swings his racquet, the center of the tennis racquet face will pass over the lid 14. The player then just strokes the ball using either a forehand, backhand, overhand or serving stroke. The practice device will return the ball in a regular and not erratic trajectory.

When the user has finished practicing with the device, the weighting material 12 may be removed from container 10. The removable leader 20 may be removed from cotter type fastener 16 and the elastic line and ball may be placed inside container 10 for storage. If leader 20 is left attached to cotter type fastener 16 and the ball and most of elastic line 18 placed inside the container, a loop 28 will be formed by the elastic line 18 in the vicinity of lid 14 so that the container may be easily carried with the ball 24 and most of the line 18 conveniently stored inside.

Lid 14 is threadably attached to the top of container 10 by means of cooperating threads whose shape and size permit the elastic line 18 to pass between the threads when lid 14 is screwed on tight to container 10 without damaging elastic line 18.

It can be seen that the tennis practice device of the present invention is designed for easy portability and for easy repair. Elastic line 18 may be easily replaced if it breaks or becomes knotted. The elastic line 18 does not connect directly to the tennis ball 24 but is attached by means of an adapter line 26 which further facilitates easy replacement of line 18.

Although the invention has been illustrated in a preferred embodiment, it will be clear to those skilled in the art that modifications may be made within the scope of the invention. It is therefore intended that my invention not be limited except as in the appended claims.

What is claimed is:

1. A tennis practice device comprising:

a hollow container adapted for receiving a weighting material;

a lid threadably attached to said container for enclosing said weighting material;

an elongated elastic line;

means for attaching one end of said elastic line to said lid;

a tennis ball; and, means for attaching the other end of said elongated elastic line to a tennis ball;

the threads of said lid being adapted to permit said elastic line to pass therebetween without damaging said elastic line when said lid is threadably attached to said container.

2. The device of claim 1 wherein the means for attaching one end of said elongated elastic line to said lid includes:

a cotter pin type fastener projecting through a hole in said lid;

a leader removably attached to said fastener;

a swivel attached to said leader, said elastic line being attached to said swivel.

3. The device of claim 1 wherein said means for attaching said elongated elastic line to said tennis ball includes:

an adapter line passed through punctures on opposite sides of said tennis ball, the free ends of said adapter secured together to form a loop outside said tennis ball said elastic line being attached to said loop.

4. The device according to claim 3 wherein said elongated elastic line is tied in a loop to said adapter whereby said elastic line loop can slide along said adapter.

5. The device according to claim 1 wherein the tennis ball is a pressureless ball.

6. The device of claim 1 wherein said tennis ball and a portion of said elastic line is stored inside said container and the remaining portion of said line extends out of said container and attaches to said lid to provide a handle for carrying said device while not in use.

7. The device of claim 1 wherein the container has a generally cylindrical shape with a height greater than the diameter of the base.

8. The device of claim 1 wherein the relaxed length of said elongated elastic line is in the range of 13 to 17 feet.

* * * * *